US011274595B1

(12) United States Patent
Farhat et al.

(10) Patent No.: US 11,274,595 B1
(45) Date of Patent: Mar. 15, 2022

(54) SYSTEM AND METHOD FOR ENGINE COOLING SYSTEM

(71) Applicant: Ford Global Technologies, LLC, Dearborn, MI (US)

(72) Inventors: Hassan Farhat, Dearborn, MI (US); Ravi Gopal, Novi, MI (US); Yixin Yao, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/023,874

(22) Filed: Sep. 17, 2020

(51) Int. Cl.

| | |
|---|---|
| ***F01P 7/04*** | (2006.01) |
| ***F01P 7/02*** | (2006.01) |
| ***F01P 5/02*** | (2006.01) |
| ***F01P 3/18*** | (2006.01) |
| ***F01P 5/10*** | (2006.01) |

(52) U.S. Cl.
CPC ..... *F01P 7/04* (2013.01); *F01P 3/18* (2013.01); *F01P 5/02* (2013.01); *F01P 5/10* (2013.01); *F01P 2025/34* (2013.01); *F01P 2025/36* (2013.01)

(58) Field of Classification Search
CPC .... F01P 11/16; F01P 7/164; F01P 7/04; F01P 7/167; F01P 5/02; F01P 5/12; F01P 5/04; F04D 27/004; F04D 25/0606; F04D 19/002; F02D 2200/021; F02D 41/26; F02D 41/221; F02D 41/222
See application file for complete search history.

(56) References Cited

U.S. PATENT DOCUMENTS

| | | | | |
|---|---|---|---|---|
| 6,651,761 | B1 | 11/2003 | Hrovat et al. | |
| 6,739,290 | B2 | 5/2004 | Iwasaki et al. | |
| 6,955,141 | B2 | 10/2005 | Santanam et al. | |
| 7,328,852 | B2 * | 2/2008 | Paolillo | B60H 1/0073 237/12.3 B |
| 8,997,847 | B2 | 4/2015 | Schwartz | |
| 10,174,664 | B2 | 1/2019 | Toyama et al. | |
| 10,371,041 | B2 | 8/2019 | Toyama et al. | |
| 2006/0185626 | A1 * | 8/2006 | Allen | F02M 26/28 123/41.12 |
| 2006/0288967 | A1 | 12/2006 | Joyce et al. | |
| 2012/0253573 | A1 * | 10/2012 | Shigyo | B60H 1/3213 701/22 |
| 2013/0255604 | A1 * | 10/2013 | Rollinger | F01P 7/048 123/41.15 |
| 2015/0191078 | A1 * | 7/2015 | Miyaji | B60K 11/085 701/49 |
| 2016/0290216 | A1 * | 10/2016 | Katragadda | F01P 11/16 |
| 2017/0030274 | A1 * | 2/2017 | Nakanishi | F01P 11/16 |
| 2019/0093546 | A1 * | 3/2019 | Takagi | F01P 7/164 |
| 2019/0165396 | A1 * | 5/2019 | Farnsworth | H01M 8/04358 |
| 2020/0300550 | A1 * | 9/2020 | Hall | B60H 1/08 |

* cited by examiner

*Primary Examiner* — Long T Tran
(74) *Attorney, Agent, or Firm* — Geoffrey Brumbaugh; McCoy Russell LLP

(57) ABSTRACT

Methods and systems are provided for adjusting operation of each of a pump and a fan of an engine cooling system. In one example, a method may include adjusting a speed of the pump and a speed of the fan based on one or more of a temperature of coolant entering a heat exchanger of the cooling system, a temperature of air exiting the heat exchanger, and a temperature of air entering the heat exchanger.

19 Claims, 6 Drawing Sheets

SYSTEM AND METHOD FOR ENGINE COOLING SYSTEM

FIELD

The present description relates generally to methods and systems for adjusting operation of electric pumps and fans of an engine driven, hybrid, fuel cell or electric vehicle cooling system.

BACKGROUND/SUMMARY

Vehicle cooling systems may include various cooling components such as radiators, cooling fans and blowers, condensers, liquid coolant, etc. An electrically driven engine cooling fan may be powered by an electric motor that is either variable speed or relay controlled. The liquid coolant may be circulated through the engine components by operating an electrically driven coolant pump. When engine temperatures (or engine coolant temperatures) exceed the target range, the cooling fan is operated and/or the pump speed is increased to increase airflow and/or coolant flow through the engine, which carries the undesirable heat away to the outside air or to the coolant. The cooling fan is typically located in the engine compartment, at the front or rear of the radiator. Upon heat transfer from the engine to the coolant, the coolant may be circulated through a heat exchanger such as a radiator where the heat is dissipated, and the coolant is cooled before being circulated back to the engine. As the cooling fan operates to direct air to the engine, the cooling air flows through radiator, also cooling the coolant.

Various approaches are provided for operating the coolant pump and the fan in an engine cooling system. In one example, as shown in U.S. Pat. No. 8,997,847, Schwartz teaches adjusting a fan speed or a coolant pump speed based on an increase in heat transfer rate. The choice of increasing the fan speed or increasing the pump speed may be determined such that power consumption is minimized. A map of radiator performance may be used in estimating the heat transfer rate.

However, the inventors herein have recognized potential issues with such systems. As one example, in air to liquid heat exchanger, effective cooling may not be realized by only increasing the coolant flow rate, without orchestrated changes in the fan speed. Further, Schwartz describes a computation intensive estimation of heat transfer rate based on effectiveness, heat capacity and mass flow rate of the coolant. An efficient operation of the cooling system is desired for improving fuel efficiency while attaining the desired engine cooling.

In one example, the issues described above may be addressed by a method for operating a vehicle, the method comprising: adjusting a speed of a cooling fan and a speed of a cooling pump of the vehicle based on a ratio of temperature differences of a heat exchanger. The ratio of temperature differences may be the effectiveness of the heat exchanger. The speed of the cooling fan may be gradually adjusted to achieve desired cooling by using lowest possible airflow based on a rate of change in coolant temperature entering the heat exchanger, and the speed of the cooling pump may be adjusted to attain improved radiator effectiveness. In this way, speed of the fan and speed of the pump may be adjusted to maximize effectiveness of the radiator, attain desired cooling, and reduce parasitic loss of power.

As one example, a first coolant temperature sensor may be coupled to a coolant inlet via which coolant (after flowing through the engine) enters the radiator. A first air temperature sensor may be coupled to a first side of the radiator facing a grill shutter through which ambient air flows to the radiator and a second air temperature sensor may be coupled to a second side of the radiator proximal to the fan. A difference in air temperature across the radiator may be monitored. Effectiveness of the radiator may be estimated based on the temperature of coolant entering the radiator and the difference in air temperature across the radiator. The effectiveness of the radiator may be sampled at a predetermined rate. Fan speed may be adjusted based on incremental changes in the temperature of coolant entering the radiator and pump speed may be adjusted based on a rate of change in effectiveness of the radiator.

In this way, accuracy of estimation of effectiveness of the radiator based on temperature of coolant entering the radiator and change in air temperature across the radiator may be improved. The technical effect of adjusting fan speed and pump speed based on a change in coolant temperature change over time and radiator effectiveness is that effectiveness of the radiator may be maximized with a smaller increase in fan speed, thereby reducing parasitic loss of power while providing a desired level of engine cooling.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
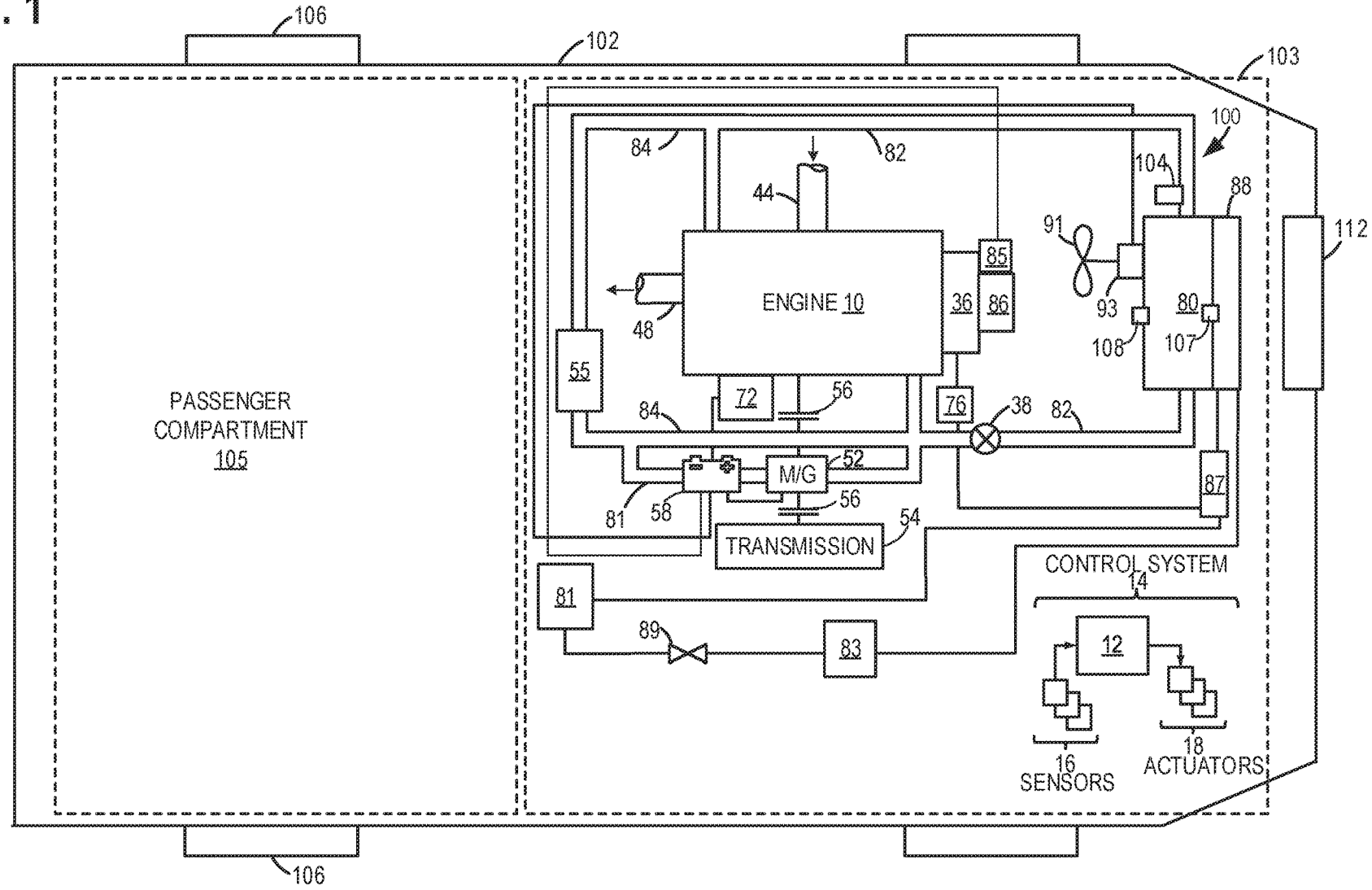
FIG. 1 shows a schematic diagram of a cooling system in a motor vehicle.

The following description relates to systems and methods for adjusting speed of a pump and speed of a fan of a cooling system, such as the cooling system shown in FIG. 1. In order to optimize power usage by a water pump and a fan of the cooling system while satisfying engine cooling functionalities, fan speed and pump speed may be adjusted based on an effectiveness of a heat exchanger such as a radiator of the cooling system. An engine controller may be configured to perform control routines, such as the example routine of FIG. 2, to estimate the effectiveness of the radiator. Changes in performance capability and effectiveness of the radiator with coolant flow rate through the radiator are respectively shown in FIGS. 5A, 5B. Example adjustments to pump speed and fan speed may be carried out following the control routines of FIGS. 3A-4.

FIG. 1 is a schematic depiction of an example embodiment of a vehicle cooling system 100 in a motor vehicle 102. Vehicle 102 has wheels 106, a passenger compartment 105, and an under-hood compartment 103. Under-hood compartment 103 may house various under-hood components under the hood (not shown) of motor vehicle 102. For example, under-hood compartment 103 may house an internal combustion engine 10. Internal combustion engine 10 has a combustion chamber that may receive intake air via an intake passage 44 and may exhaust combustion gases via an exhaust passage 48. In one example, intake passage 44 may be configured as a ram-air intake, wherein the dynamic pressure created by moving vehicle 102 may be used to increase a static air pressure inside the engine's intake manifold. As such, this may allow a greater mass flow of air through the engine, thereby increasing engine power. Engine 10 as illustrated and described herein may be included in a vehicle such as a road automobile, among other types of vehicles. While the example applications of engine 10 will be described with reference to a vehicle, it should be appreciated that various types of engines and vehicle propulsion systems may be used, including passenger cars, trucks, etc.

In some examples, vehicle 102 may be a hybrid electric vehicle (HEV) with multiple sources of torque available to one or more of wheels 106. In other examples, vehicle 102 is a conventional vehicle with only an engine or an electric vehicle with only an electric machine(s). In the example shown, vehicle 102 includes engine 10 and an electric machine 52. Electric machine 52 may be a motor or a motor/generator. A crankshaft (not shown) of engine 10 and electric machine 52 are connected via transmission 54 to vehicle wheels 106 when one or more clutches 56 are engaged. In the depicted example, a first clutch 56 is provided between engine 10 (e.g., between the crankshaft of engine 10) and electric machine 52, and a second clutch 56 is provided between electric machine 52 and transmission 54. A controller 12 may send a signal to an actuator of each clutch 56 to engage or disengage the clutch, so as to connect or disconnect the crankshaft from electric machine 52 and the components connected thereto, and/or connect or disconnect electric machine 52 from transmission 54 and the components connected thereto. Transmission 54 may be a gearbox, a planetary gear system, or another type of transmission.

The powertrain may be configured in various manners, including as a parallel, a series, or a series-parallel hybrid vehicle. In electric vehicle embodiments, a system battery 58 may be a traction battery that delivers electrical power to electric machine 52 to provide torque to vehicle wheels 106. In some embodiments, electric machine 52 may also be operated as a generator to provide electrical power to charge system battery 58, for example, during a braking operation. It will be appreciated that in other embodiments, including non-electric vehicle embodiments, system battery 58 may be a typical starting, lighting, ignition (SLI) battery coupled to an alternator 72.

Alternator 72 may be configured to charge system battery 58 using engine torque via the crankshaft during engine running. In addition, alternator 72 may power one or more electrical systems of the engine, such as one or more auxiliary systems including a heating, ventilation, and air conditioning (HVAC) system, vehicle lights, an on-board entertainment system, and other auxiliary systems based on their corresponding electrical demands. In one example, a current drawn on the alternator may continually vary based on each of an operator cabin cooling demand, a battery charging requirement, other auxiliary vehicle system demands, and motor torque. A voltage regulator may be coupled to alternator 72 in order to regulate the power output of the alternator based upon system usage requirements, including auxiliary system demands.

Under-hood compartment 103 may further include a cooling system 100, which circulates coolant through internal combustion engine 10 to absorb waste heat and distributes the heated coolant to a radiator 80 and/or a heater core 55 via coolant lines 82 and 84, respectively. In one example, as depicted, cooling system 100 may be coupled to engine 10 and may circulate engine coolant from engine 10 to radiator 80 via an engine-driven water pump 86 and back to engine 10 via coolant line 82. In one example, the water pump 86 may be coupled to the engine via a front end accessory drive (FEAD) 36 and rotated proportionally to engine speed (engine driven) via a belt, chain, etc. In another example, the water pump 86 may be driven by power from the system battery 58 via a battery-driven motors 85. Specifically, pump 86 may circulate coolant through passages in the engine block, head, etc., to absorb engine heat, which is then transferred via radiator 80 to ambient air. The pressure produced by the pump is proportional to the pump speed and engine restriction which may be adjusted by adjusting the battery power delivered to the pump and the pump may operate at a speed that is not proportional to the engine speed. The temperature of the coolant may be regulated by a thermostat valve 38, located in cooling line 82, which may be kept closed until the coolant reaches a threshold temperature.

Coolant may flow through coolant line 82, as described above, and/or through coolant line 84 to heater core 55 where the heat may be transferred to passenger compartment 105 before the coolant flows back to engine 10. Coolant may additionally flow through a coolant line 81 and through one or more of electric machine (e.g., motor) 52 and system battery 58 to absorb heat from the one or more of electric machine 52 and system battery 58, particularly when vehicle 102 is a HEV or an electric vehicle. In some examples, engine-driven water pump 86 may operate to circulate the coolant through each of coolant lines 81, 82, and 84.

One or more blowers (not shown) and cooling fans may be included in cooling system 100 to provide airflow assistance and augment a cooling airflow through the under-hood components. For example, cooling fan 91, coupled to radiator 80, may be operated when the vehicle is moving and the engine is running to provide cooling airflow assistance through radiator 80. The cooling fan may be coupled behind radiator 80 (when looking from a grille 112 toward engine 10). In one example, cooling fan 91 may be configured as a bladeless cooling fan. That is, the cooling fans may be configured to emit airflow without the use of blades or vanes, thereby creating an airflow output area that is absent of vanes or blades. Cooling fan 91 may draw a cooling airflow into under-hood compartment 103 through an opening in the front-end of vehicle 102, for example, through grille 112. Such a cooling airflow may then be utilized by radiator 80 and other under-hood components (e.g., fuel system components, batteries, etc.) to keep the engine and/or transmission cool. Further, the airflow may be used to reject heat from a vehicle air conditioning system. Further still, the airflow may be used to increase the performance of a turbocharged/supercharged engine that is equipped with intercoolers that reduce the temperature of the air that goes into an intake manifold of the engine. The rate of cooling airflow through the radiator 80 may vary proportional to the speed of the fan. Cooling fan 91 may be coupled to battery-driven motors 93, respectively. Motor 93 may be driven using power drawn from system battery 58.

A first coolant temperature sensor 104 may be coupled to a coolant line 82 via which coolant (after flowing through the engine) enters the radiator (also referred herein as top tank temperature). A first air temperature sensor 107 may be coupled to a first side of the radiator facing the grille 112 and a second air temperature sensor 108 may be coupled to a second side of the radiator 80 proximal to the fan 91. Ambient air may enter the cooling system through the grille 112 and flow through the radiator 80 from its first side to its second side. The fan 91 assisted by RAM air further adds cooling air flow towards the engine.

A speed of operation of the fan 91 may be adjusted in increments of time based on a rate of change in coolant temperature entering the radiator, such that the rate of change in coolant temperature entering the radiator gradually decreases. At each fan speed, the speed of operation of the pump 86 may be adjusted based on a ratio of temperature differences of a radiator 80 over time. The ratio of temperature differences may include a first difference between a temperature of coolant entering the heat exchanger and a temperature of air entering the radiator 80 and a second difference between a temperature of air exiting the heat exchanger and the temperature of air entering the radiator 80. In one example, in response to the temperature of the coolant entering the radiator 80 being between a first temperature threshold and a second temperature threshold, each of the speed of the fan and the speed of the pump may be incrementally increased, the first temperature threshold lower than the second temperature threshold. The ratio of temperature differences may be sampled at threshold intervals of time. In one example, in response to an average ratio being lower than a threshold ratio and a change in the temperature of coolant being within a threshold range, each of the speed of the fan 91 and the speed of the pump 86 may be decreased. In another example, in response to the temperature of the coolant entering the radiator 80 being higher than the second temperature threshold, the speed of the fan 91 may be increased to a maximum fan speed and the speed of the pump may be increased incrementally while sampling the ratio. In yet another example, in response to an average change in the ratio being lower than the threshold ratio and the temperature of the coolant entering the radiator 80 being higher than the second temperature threshold, the speed of the pump 86 may be increased while maintaining operation of the fan 91 at the maximum fan speed.

In one example, system battery 58 may be charged using electrical energy generated during engine operation via alternator 72. For example, during engine operation, engine generated torque (in excess of what is required for vehicle propulsion) may be transmitted to alternator 72 along a drive shaft (not shown), which may then be used by alternator 72 to generate electrical power, which may be stored in an electrical energy storage device, such as system battery 58. System battery 58 may then be used to activate battery-driven (e.g., electric) fan motor 93 and pump motor 85.

Under-hood compartment 103 may further include an air conditioning (AC) system comprising a condenser 88, a compressor 87, a receiver drier 83, an expansion valve 89, and an evaporator 81 coupled to a blower (not shown). Compressor 87 may be coupled to engine 10 via FEAD 36 and an electromagnetic clutch 76 (also known as compressor clutch 76), which allows the compressor to engage or disengage from the engine based on when the air conditioning system is turned on and switched off. Compressor 87 may pump pressurized refrigerant to condenser 88, mounted at the front of the vehicle. Condenser 88 may be cooled by cooling fans 91 and 95, thereby, cooling the refrigerant as it flows through. The high pressure refrigerant exiting condenser 88 may flow through receiver drier 83 where any moisture in the refrigerant may be removed by the use of desiccants. Expansion valve 89 may then depressurize the refrigerant and allow it to expand before it enters evaporator 81 where it may be vaporized into gaseous form as passenger compartment 105 is cooled. Evaporator 81 may be coupled to a blower fan operated by a motor (not shown), which may be actuated by system voltage.

System voltage may also be used to operate an entertainment system (radio, speakers, etc.), electrical heaters, windshield wiper motors, a rear window defrosting system, and headlights, amongst other systems.

FIG. 1 further shows a control system 14. Control system 14 may be communicatively coupled to various components of engine 10 to carry out the control routines and actions described herein. For example, as shown in FIG. 1, control system 14 may include controller 12. Controller 12 may be a microcomputer, including a microprocessor unit, input/output ports, an electronic storage medium for executable programs and calibration values, random access memory, keep alive memory, and a data bus. As depicted, controller 12 may receive input from a plurality of sensors 16, which may include user inputs and/or sensors (such as transmission gear position, gas pedal input, brake input, transmission selector position, vehicle speed, engine speed, engine temperature, ambient temperature, intake air temperature, etc.), cooling system sensors (such as coolant temperature, fan speed, radiator inlet and outlet air temperatures, passenger compartment temperature, ambient humidity, etc.), and others (such as Hall Effect current sensors from the alternator and battery, a system voltage regulator, etc.). Further, controller 12 may communicate with various actuators 18, which may include engine actuators (such as fuel injectors, an electronically controlled intake air throttle plate, spark plugs, etc.), cooling system actuators (such as motor actuators, motor circuit relays, etc.), and others. In some examples, the storage medium may be programmed with computer readable data representing instructions executable by the processor for performing the methods described below as well as other variants that are anticipated but not specifically listed. Controller 12 may adjust the adjusting speed of the pump 86 circulating coolant through the cooling system and a speed of the fan 91 coupled to the radiator 80 based on a thermal load (rate of change in temperature of coolant entering the radiator) and an estimated effectiveness of the radiator 80.

In this way, the systems of FIG. 1 provide for an engine of a vehicle, comprising: a controller including executable instructions stored in a non-transitory memory that cause the controller to: during engine operation, adjust speed of a fan and a speed of a pump of a cooling system based on one or more of an estimated effectiveness of a radiator of the cooling system and a temperature of coolant entering the radiator, populate a model relating the speed of the fan and the speed of the pump with a higher than threshold effectiveness of the radiator, and further adjust the speed of the fan and the speed of the pump based on the temperature of coolant entering the radiator and the model. The model may be populated based on the speed of the pump, the speed of the fan, and the effectiveness of the radiator corresponding to a plurality of vehicle speed, the model selecting the speed of the pump corresponding to the speed of the fan for a maximum effectiveness of the radiator. In one example, further adjusting the speed of the fan and the speed of the pump includes in response to the temperature of the coolant entering the radiator being between a first temperature threshold and a second temperature threshold, incrementally increasing each of the speed of the fan and adjusting the speed of the pump corresponding to the speed of the fan based on the model, the first temperature threshold lower than the second temperature threshold. In another example, further adjusting the speed of the fan and the speed of the pump further includes in response to the temperature of the coolant entering the radiator being higher than the second temperature threshold, increasing the speed of the fan to a maximum fan speed and adjusting the speed of the pump corresponding to the maximum fan speed based on the model, to ensure higher radiator effectiveness.

Figure 2:
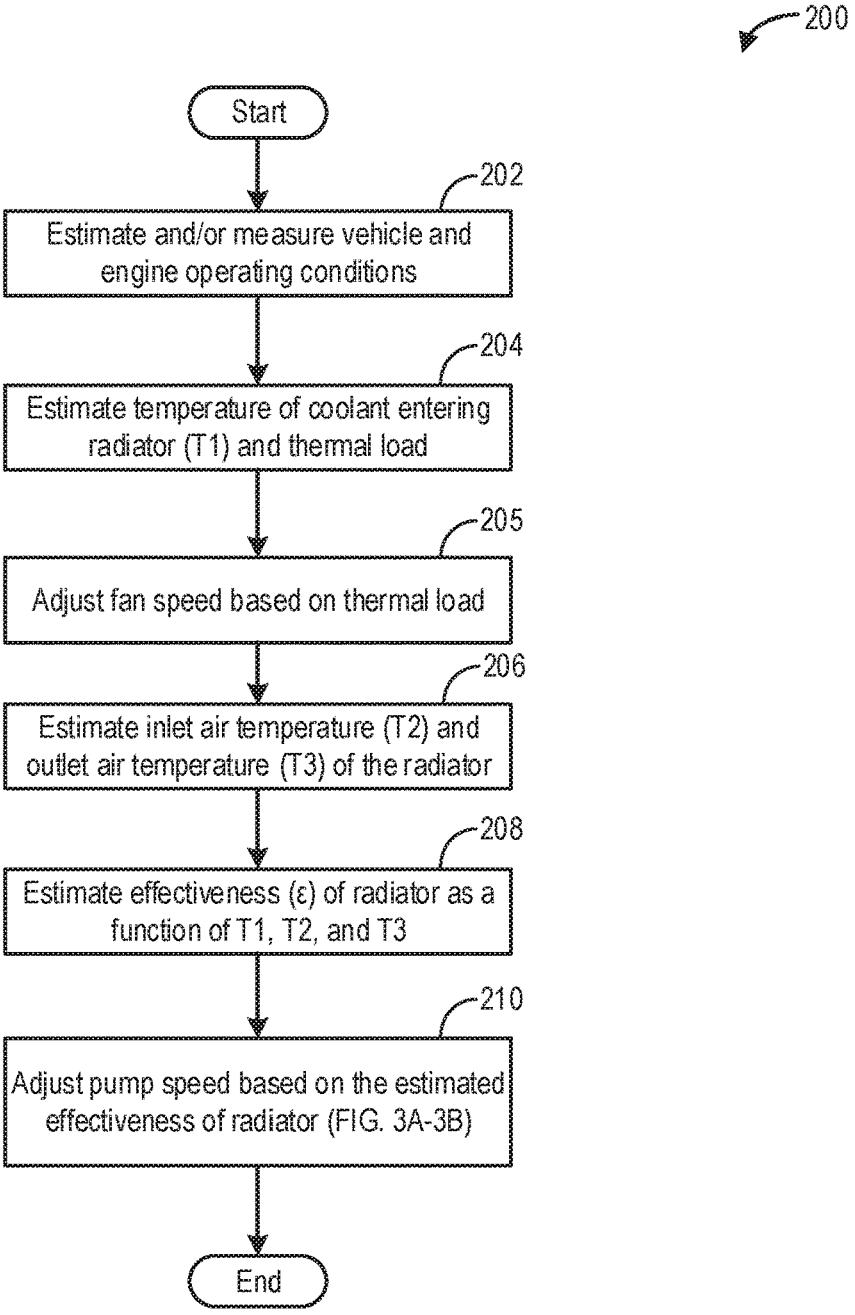
FIG. 2 shows a flow chart of an example method for estimating effectiveness of a radiator.

FIG. 2 shows a flow chart of an example method 200 for estimating effectiveness of a radiator (such as radiator 80 in FIG. 1) of an engine cooling system. Instructions for carrying out method 200 and the rest of the methods included herein may be executed by a controller (e.g., controller 12 of FIG. 1) based on instructions stored on a memory of the controller and in conjunction with signals received from sensors of the engine system, such as the sensors described above with reference to FIG. 1. The controller may employ engine actuators of the engine system to adjust engine operation, according to the methods described below.

At 202, the method includes estimating and/or measuring vehicle and engine operating conditions. Operating conditions may include, for example, vehicle speed, engine speed and load, driver torque demand, and road conditions (e.g., road grade), weather conditions (e.g., presence of wind, rain, snow, etc.), the settings of grille shutters coupled to the front end of the vehicle, etc. The operating conditions may further include ambient conditions, such as ambient air temperature, pressure, and humidity; engine temperature; coolant temperature; transmission fluid temperature; engine oil temperature; cabin air settings (e.g., AC settings); boost pressure (if the engine is boosted); exhaust gas recirculation (EGR) flow; manifold pressure (MAP); manifold airflow (MAF); manifold air temperature (MAT); etc. When the vehicle is a HEV, operating conditions may further include a mode of operation, such as an engine-only mode (where all of the torque to propel the vehicle is supplied by the engine), an electric-only mode (where all of the torque to propel the vehicle is supplied by an electric machine), and an assist mode (where the torque to propel the vehicle is supplied by both the engine and the electric machine). Operating conditions may further include a temperature of the electric machine and/or a temperature of the system battery.

At 204, temperature (T1) of coolant entering the radiator via a coolant line may be estimated via a temperature sensor (such as temperature sensor 104 in FIG. 1) coupled to a coolant inlet of the radiator. The temperature sensor may estimate temperature of coolant entering the radiator after circulating through the engine with heat from the engine being transferred to the coolant. Further, a thermal load on the cooling system may be estimated as a rate of change in temperature of coolant entering the radiator. The coolant temperature T1 may represent a resultant of the thermal load (heat rejected to the cooling system) and the cooling provided by the cooling system. Therefore, if T1 stabilizes over time, it may be inferred that the heat rejected into the cooling system is equal to the cooling power provided by the cooling system.

At 205, a speed of a fan (such as fan 91 in FIG. 1) providing cooling air flow to the radiator and the cooling system may be adjusted based on the thermal load (rate of change of T1). In one example, the controller may use a look-up table to determine the fan speed corresponding to a measured rate of change of T1 with the rate of change of T1 as input and the fan speed as output. As an example, the fan speed may increase with an increase in the thermal load and the fan speed may decrease with a decrease in thermal load.

At 206, inlet air temperature (T2) and outlet air temperature (T3) may be estimated. The temperature of air entering the radiator (T2) may be estimated via a first air temperature sensor (such as air temperature sensor 107 in FIG. 1) coupled to a first side of the radiator facing the grille. The temperature of air exiting the radiator (T3) may be estimated via a second air temperature sensor (such as air temperature sensor 108 in FIG. 1) coupled to a second side of the radiator facing the fan, the second side opposite to the first side.

AT 208, effectiveness (c) of the radiator may be estimated as a function of each of the sensed T1, T2, and T3. Effectiveness of the radiator is an estimation of an ability of the radiator to dissipate heat from the coolant circulated through the radiator. The effectiveness of the radiator may be highest when c is 1.0 and effectiveness of the radiator may be lowest when c is 0. The effectiveness (c) may be estimated by equation 1.

$$\varepsilon = \frac{T3 - T2}{T1 - T2} \tag{1}$$

Where ε is the effectiveness of the radiator, T1 is the temperature of coolant entering the radiator, T2 is the inlet air temperature, and T3 is the outlet air temperature.

Figure 3A:
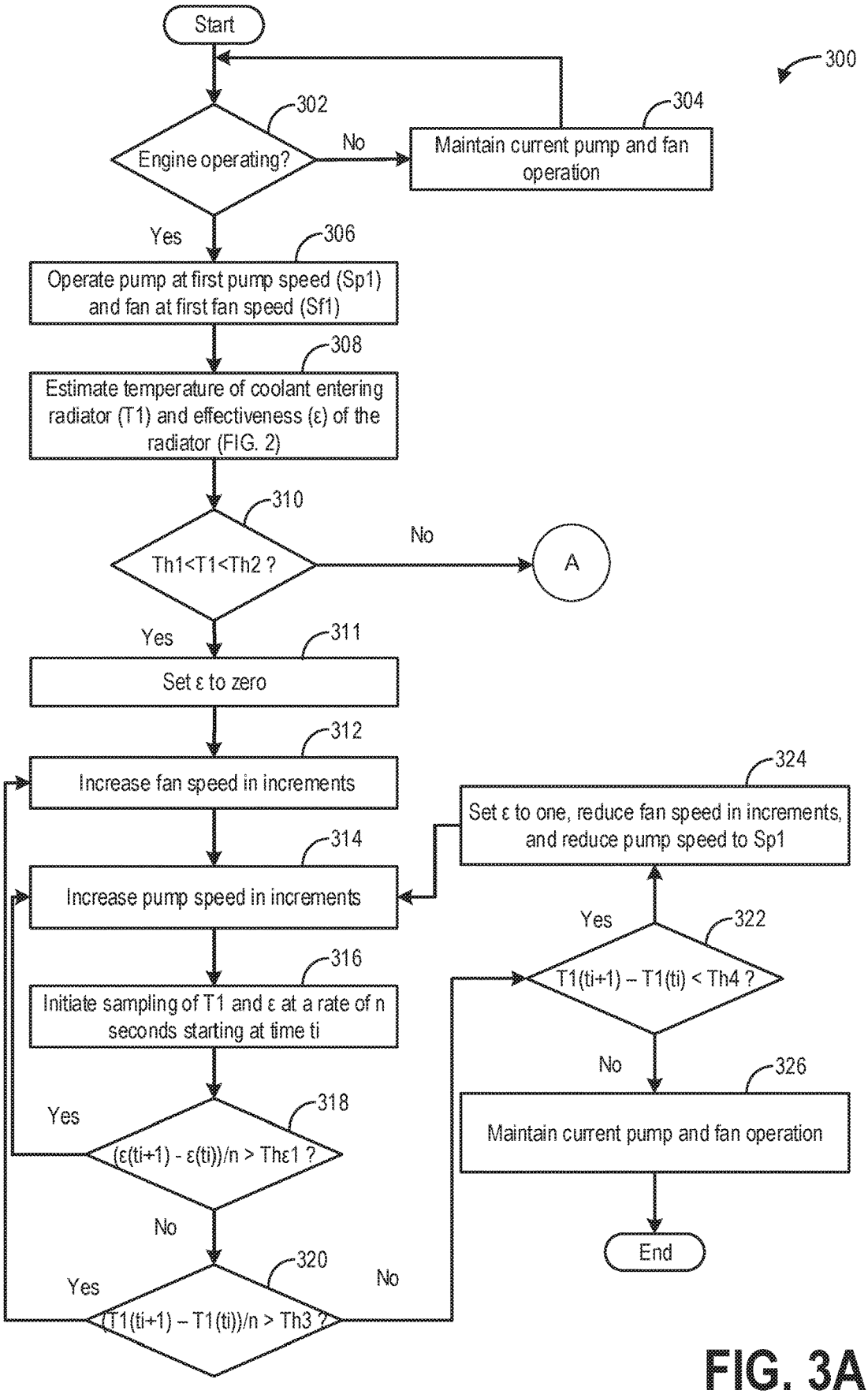
FIG. 3A-3B shows a flow chart of a first example method for adjusting water pump speed and fan speed of an engine cooling system.
Figure 3B:
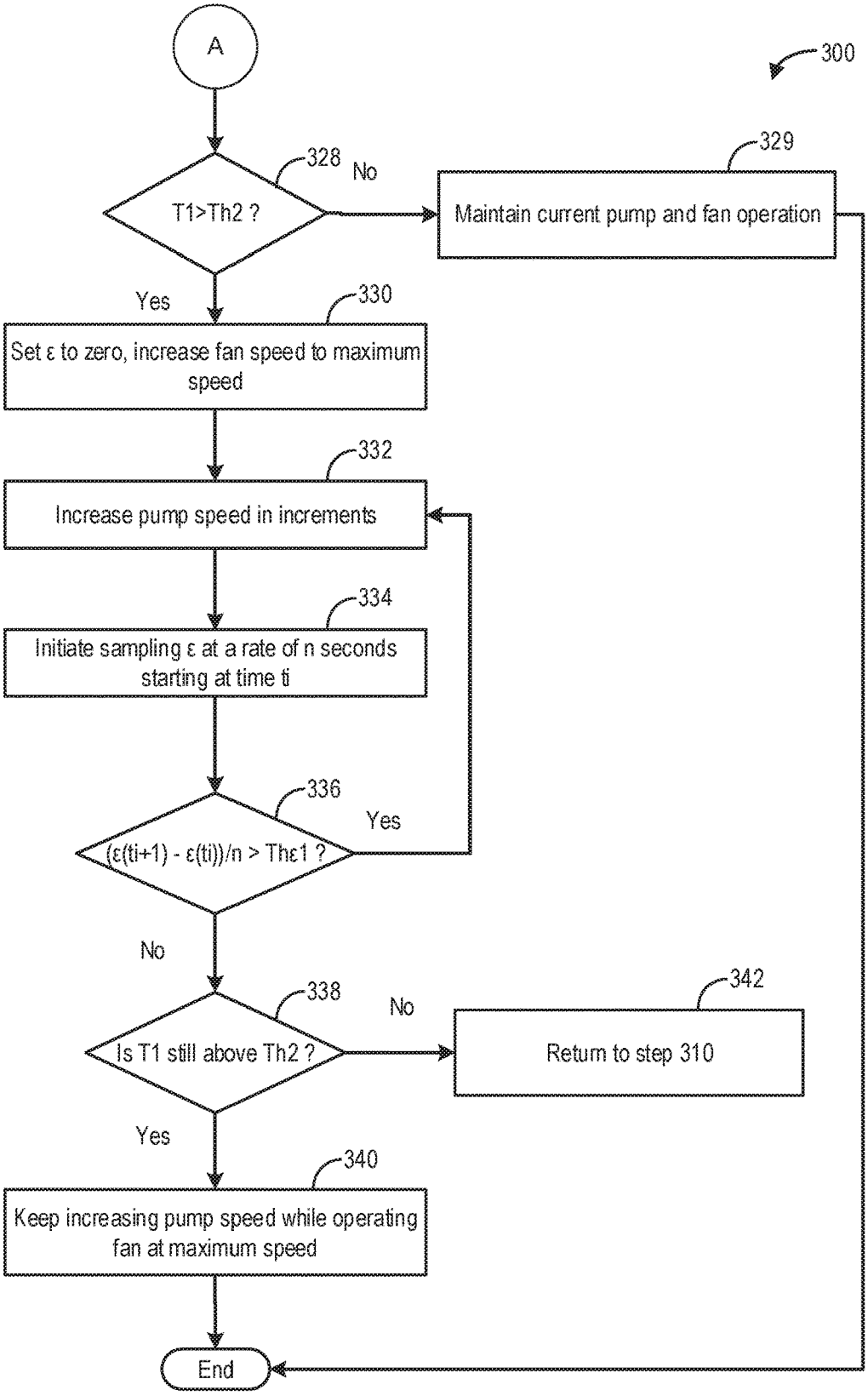
Figure 4:
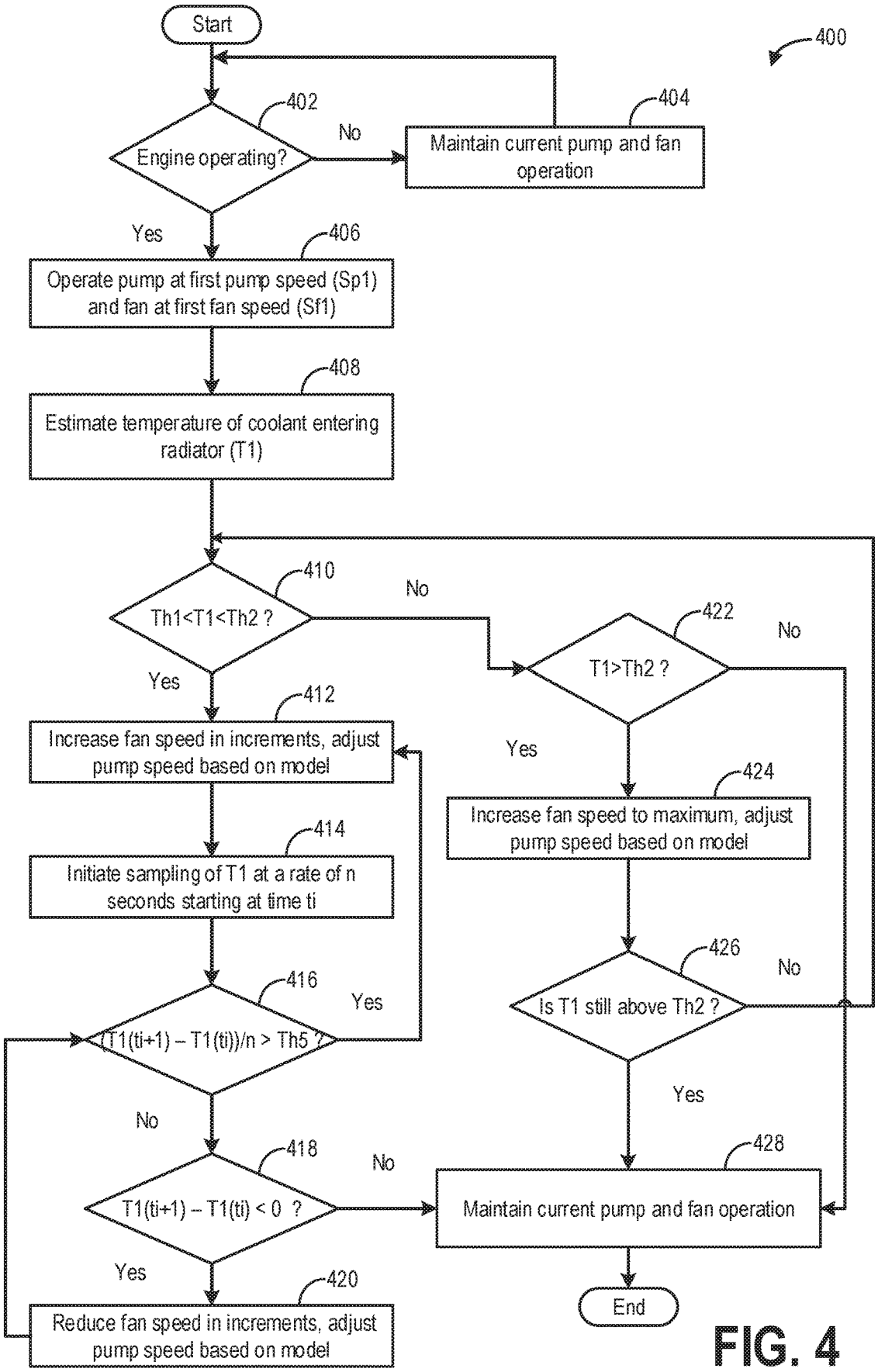
FIG. 4 shows a flow chart of a second example method for adjusting water pump speed and fan speed of an engine cooling system.

At 210, a speed of a water pump (such as pump 86 in FIG. 1) pumping coolant through the lines of the cooling system may be adjusted based on the estimated effectiveness of the radiator. By adjusting the fan speed based on the thermal load, and pump speed based on ε, engine cooling may be provided while reducing power consumption and undesired increase in pressure resistance without any effectiveness benefits. Example adjustments of water pump speed and fan speed are shown in the methods of FIGS. 3A-3B and 4.

Figure 5A:
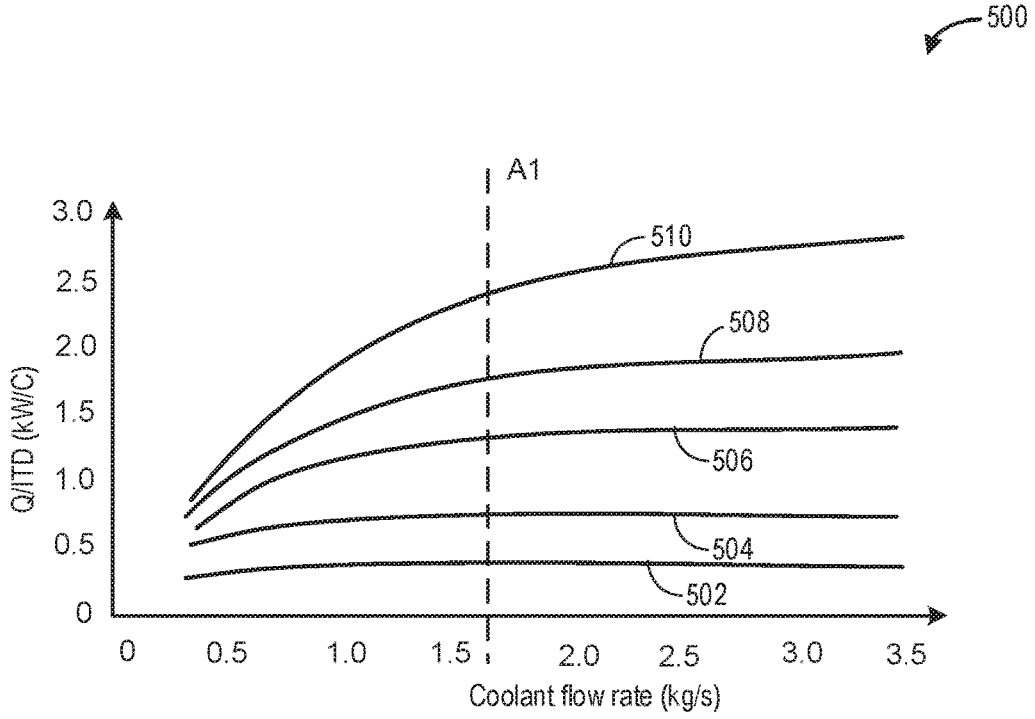
FIG. 5A shows a plot of change in performance capability of the radiator with coolant flow rate through the radiator.

FIG. 5A shows a plot 500 of change in performance capability of a radiator with coolant flow rate through the radiator. The x-axis denotes coolant flow rate (kg/s) through the radiator as estimated based on speed of the pump (such as pump 86 in FIG. 1) circulating coolant through the engine cooling system including the radiator. The y-axis axis denotes performance capability of the radiator as estimated via equation 2. The performance capability may be defined as the cooling power of the radiator per initial difference in temperature of coolant entering the radiator and air entering the radiator (inlet air temperature).

$$\frac{Q}{ITD} = \varepsilon \times \dot{m} \times c_p \tag{2}$$

where Q is the cooling power of the radiator, ITD is the initial difference in temperature of coolant entering the radiator and air entering the radiator (inlet air temperature), ε is the effectiveness of the radiator as estimated based on equation 1, $\dot{m}$ is the air mass flow rate, and $c_p$ is the specific heat of air. For improving the cooling performance of the radiator, the performance capability is to be increased. As seen from equation 2, the higher the effectiveness of the radiator, the higher is the performance capability and cooling power of the radiator. Therefore, the performance capability may be increased by increasing one or more of the effectiveness of the radiator and the air mass flow rate (such as by increasing fan speed).

The performance capability may be estimated corresponding to a plurality of air mass flow rates through the radiator. The air mass flow rate may be directly proportional to the speed of operation of the fan (such as fan 91 in FIG. 1) circulating air through the radiator. Lines 502-510 corresponds to different air flow rates through the radiator with 502 corresponding to lowest air flow are and 510 with the highest air flow rate.

As seen from the plot, for each air flow rate, performance capability of the radiator increases with an increase in coolant mass flow rate through the radiator. However, for each coolant mass flow rate, the performance capability does not change significantly above a first threshold coolant flow rate, as shown by dashed line A1, and increase in coolant flow rate beyond the threshold coolant flow rate may add to parasitic loss of power without significantly improving engine cooling. Therefore, during adjustment of pump speed and fan speed for improved engine cooling, the pump speed may be maintained to within a first threshold pump speed, the first threshold pump speed corresponding to the first threshold coolant flow rate.

Figure 5B:
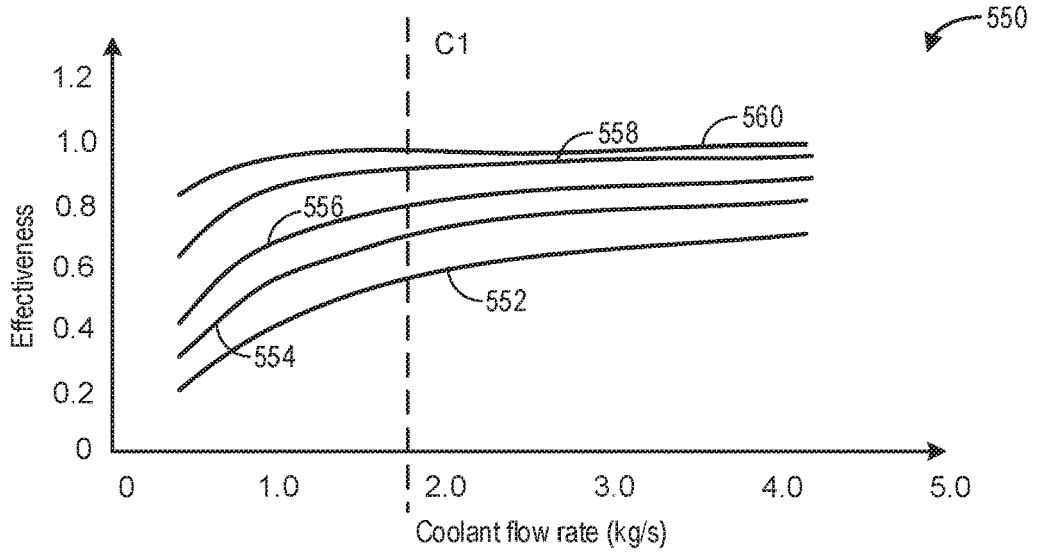
FIG. 5B shows a plot of change in radiator effectiveness with coolant flow rate through the radiator.

FIG. 5B shows a plot 550 of change in radiator effectiveness with coolant mass flow rate through the radiator. The x-axis denotes coolant mass flow rate (kg/s) through the radiator as estimated based on speed of the pump (such as pump 86 in FIG. 1) circulating coolant through the engine cooling system including the radiator. The y-axis axis denotes effectiveness of the radiator as estimated via equation 1.

The effectiveness may be estimated corresponding to a plurality of air mass flow rates through the radiator. The air mass flow rate may be directly proportional to the speed of operation of the fan (such as fan 91 in FIG. 1) providing cooling air flow through the radiator. Line 522 may correspond to an air mass flow rate of 3.888 kg/s, line 554 may correspond to an air mass flow rate of 2.333 kg/s, line 556 may correspond to a coolant mass flow rate of 1.555 kg/s, line 558 may correspond to a coolant mass flow rate of 0.777 kg/s, and line 560 may correspond to a coolant mass flow rate of 0.388 kg/s.

As seen from the plot, for each air mass flow rate, effectiveness of the radiator increases with an increase in coolant mass flow rate through the radiator. Further, effectiveness of the radiator is highest for lower air flow rate and the effectiveness may decrease with an increase in air flow rate. For each air mass flow rate, the effectiveness does not change significantly above a second threshold coolant flow rate, as shown by dashed line Cl, and increase in coolant flow rate beyond the second threshold coolant flow rate may add to parasitic loss of power without significantly improving engine cooling. Therefore, during adjustment of pump speed and fan speed for improved engine cooling, the pump speed may be maintained to within a second threshold pump speed, the second threshold pump speed corresponding to the second threshold coolant flow rate.

Therefore, from FIGS. 5A and 5B it is shown that the effectiveness of the radiator is higher at higher pump speeds and lower fan speeds. The intricate (adverse) relationship between air mass flowrate and radiator effectiveness from equation 2, necessitate for efficiently improving the cooling performance, a gradual increase in airflow to eventually attain the lowest possible rate for stabilizing the thermal system. To further enhance (at each airflow incremental step) the cooling capacity, the coolant mass flowrate is increased gradually in order to achieve the highest possible effectiveness without causing an unnecessary losses due to increased cooling system pressure.

In one example, a model (can include an algorithm and/or look-up table) may be calibrated for the effectiveness of the radiator using estimated effectiveness corresponding to each coolant mass flow rate (proportional to pump speed) and air mass flow rate (proportional to fan speed). The model may be calibrated using a range of pump speeds and fan speeds and the estimated radiator effectiveness corresponding to each set of fan speed and resulting pump speed. A 3D map of effectiveness vs. coolant flow rate and air flow rate, a 3D map of air flow rate vs. fan speed and vehicle speed, and a graph for coolant flow rate vs. pump speed may be used in populating and calibrating the model.

In one example, the model may be populated based on data collected from high fidelity 1D solvers for coolant flow as related to pressure drop in the cooling system. As the pump (configured as a centrifugal pump) pushes coolant flow through a cooling system, the system restrictions may dictate the system pressure and determine the allowable flow of coolant through the system. The pressure drop through the cooling system may be estimated as a difference of pressure before and after the pump. The final coolant flow in the cooling system may be estimated based on each of the pressure drop through the system and by the commanded pump speed. Based on a 1D model of the cooling system, coolant flow (as influenced by the pressure drop through the system) through the cooling system may be mapped to pump speed and a graph of coolant flow (through the particular cooling system) as function of pump speed may be populated.

In another example, 3D computational fluid dynamics (CFD) with data validated by experimental testing may be used to populate the model. The vehicle may be operated at a plurality of vehicle speeds and for each vehicle speed, the fan may be operated at a plurality of speeds, and airflow rates through the radiator may be estimated for each fan speed. The estimated airflow rates may be used to derive a 3D equation, which may be used to determine an airflow rate for every vehicle speed and fan speed combination. The 3D equation for calculating the effectiveness may be used to determine effectiveness of the radiator based on the airflow and coolant flow rates.

The model may be used to determine pump speed based on feedback signals from vehicle speed and fan speed to meet current cooling system operation such that the effectiveness of the radiator is maximized. In one example, a vehicle speed of 50 kph and a fan speed of 3200 rpm, may result in a mass air flowrate of 1.315 kg/s. A range of coolant flowrates is probed with their corresponding effectiveness slopes. An effectiveness threshold slope of 0.07 with respect to coolant flowrate (left of dashed line Cl in FIG. 5B) is used to determine a pump speed of 75%. Effectiveness slope may be defined as effectiveness measured at time ti and effectiveness measured at time ti+n (such as n seconds after time ti) divided by n. The fan speed of 3200 rpm coupled with a pump speed of 75% may result in radiator effectiveness of 0.855 and coolant mass flowrate of 1.84 kg/s. As an example, the estimation of pump speed based on fan speed signal may be carried out using a predefined algorithm (such as using a Matlab m. script), embedded in the control strategy, or the estimation lookup tables may be used to determine a pump speed corresponding to a fan speed in order to achieve increased radiator effectiveness.

By maintaining operation of the cooling system with an increased radiator effectiveness, parasitic loss of power may be reduced. In this way, pump speed and fan speed may be adjusted to maintain a higher threshold effectiveness of the radiator while providing a desired engine cooling. FIG. 4 shows an example method of adjusting fan and pump operation based on the model.

FIG. 3A and FIG. 3B show a flow-chart of a first example method 300 for adjusting a speed of a water pump (such as pump 86 in FIG. 1) circulating coolant through an engine cooling system and a speed of a fan (such as fan 91 in FIG. 1) supplying air flow through a heat exchanger (such as radiator 80 in FIG. 1) of the cooling system. In this method, one or more of an estimated temperature of coolant entering the radiator (T1), an estimated inlet air temperature (T2), and an estimated outlet air temperature (T3) may be used for adjusting the pump speed and the fan speed.

At 302, the routine includes determining if the engine is operating. Engine operation may include combustion of fuel and air in engine cylinders to generate power. Engine operation also causes generation of heat which is dissipated via the cooling system. If it is determined that the engine is not operating, at 304, current pump and fan operation may be maintained. In one example, if the vehicle is not operating such that the engine and the electric motor is not used to propel the vehicle, coolant circulation through the engine may be suspended through the engine and the pump may be maintained in an off state. Similarly, if the vehicle is not operating, due to engine cooling not being desired, the fan may be maintained in an off state. In another example, if the vehicle is being propelled via torque from an electric machine and cooling of electric machine components is desired, the pump and the fan may be operated at pre-calibrated speeds to circulate coolant through one or more of the electric machine (e.g., motor) and system battery to absorb heat from the one or more of electric machine and system battery. The pre-calibrated fan speed and pump speed may be based on an amount of heat generated during operation of the electric machine when the engine is not combusting.

If it is determined that the engine is operating, it is inferred that engine cooling is desired. At 306, the pump maybe operated at a first pump speed (Sp1) and the fan may be operated at a first fan speed (Sf1). In one example, Sp1 and Sf1 may be determined based on engine operating conditions such as engine load, engine speed, and engine temperature. In one example, the controller may use a look-up table to estimate-Sp1 and Sf1 with the engine operating conditions as inputs and Sp1 and Sf1 as outputs. In another example, Sp1 and Sf1 may be set initially based on the cooling system characteristics and then fine-tuned via calibration (such as based on coolant temperature and effectiveness of the radiator). As an example, the Sp1 may be operating the pump at 30% cycle and Sf1 may be operating the fan at 10% of maximum speed.

At 308, temperature (T1) of coolant entering the radiator via a coolant line may be estimated via a temperature sensor (such as temperature sensor 104 in FIG. 1) coupled to a coolant inlet of the radiator. The temperature sensor may estimate temperature of coolant entering the radiator after circulating through the engine with heat from the engine being transferred to the coolant. Inlet air temperature (T2) and outlet air temperature (T3) may be estimated via temperature sensors installed on the front and back airside of the Radiator. An effectiveness (c) of the radiator may be estimated as a function of the estimated coolant temperature (T1), inlet air temperature of the radiator (T2), and outlet air temperature of the radiator (T3). Effectiveness may be estimated as a ratio of a difference between a difference between the coolant temperature and the inlet air temperature and a difference between the outlet air temperature and the inlet air temperature. A method for estimation of effectiveness (c) of the radiator is elaborated in FIG. 2.

At 310, the routine includes determining if the coolant temperature (T1) is higher than a first threshold temperature (Th1) but lower than a second threshold temperature (Th2). Th1 and Th2 may be pre-calibrated based on engine operating conditions such as engine load, engine speed, and engine temperature. Th1 may be lower than Th2. In one example, Th1 may be 35° C. and Th2 may be 60° C. If it is determined that the T1 is between Th1 and Th2, at 311, c may be set to zero. At 312, the fan speed may be increased in increments. In one example, the fan speed may be increased in increments of 10%. At 314, the pump speed may be increased in increments. In one example, the pump speed may be increased in increments of 5%.

At 316, a timer may be set at time ti and sampling of T1 and c may be initiated at intervals of n seconds calibrated based on the thermal mass of the system. Said another way, after the initial start time, dented as ti, T1 and c may be estimated every n seconds. In one example, n may be 30 seconds.

At 318, the routine includes determining if a rate of change in effectiveness as given by a difference between effectiveness measured at time ti+1 (such as n seconds after ti) and effectiveness measured at time ti divided by n is higher than a first threshold effectiveness slope (Thε1). Thε1 may be pre-calibrated based on radiator characteristics. In one example, Thε1 may be 0.0008. If it is determined that (ε(ti+1)−ε(ti))/n is greater than Thε1 (for example (0.75−0.7)/30=0.00167), it may be inferred that an increase in coolant mass flow rate may be desired and the routine may return to step 314 and pump speed may be increased in increments. If it is determined that (ε(ti+1)−ε(ti))/n is less than Thε1, the routine proceeds to step 320.

At 320, the routine includes determining if a rate of change in coolant temperature as given by a difference between coolant temperature at time ti+1 (such as n seconds after ti) and coolant temperature at time ti divided by n is greater than a third threshold temperature (th3). Th3 may be pre-calibrated based on engine operating conditions such as engine load, engine speed, engine temperature. In one example, Th3 may be 2° C. If it is determined that (T1(ti+1)−T1(ti))/n is greater than Th3, it may be inferred that an increase in air flow may be desired, and the routine may return to step 312 and fan speed may be increased in increments. If it is determined that (T1(ti+1)−T1(ti))/n is less than Th3, the routine may proceed to step 322.

At 322, the routine includes determining if a difference between coolant temperature at time ti+1 (such as n seconds after ti) and coolant temperature at time ti is less than a fourth threshold temperature (th4). Th4 may be pre-calibrated based on engine operating conditions such as engine load, engine speed, engine temperature and system thermal mass. In one example, Th4 may be 0° C. If it is determined that T1(ti+1)−T1(ti) is lower than Th4, it may be inferred that overcooling condition may be present and the routine may proceed to step 324 to reduce the level of engine cooling.

At 324, ε may be set to one denoting that the radiator is operating at highest effectiveness. The fan speed may be reduced in increments and pump speed may be reduced to the first pump speed (Sp1). In one example, the fan speed may be reduced in increments of 10%. The routine may then proceed to step 314. Upon increase in radiator effectiveness, by opportunistically reducing each of the fan speed and adjusting the pump speed, power usage may be reduced.

If it is determined that T1(ti+1)−T1(ti) is higher than Th4 while being lower than Th3, it may be inferred that the temperature of coolant entering the radiator is stabilizing over time and further increase in coolant flow or air flow is not desired. At 326, current pump and fan operation may be continued without any change in pump speed and/or fan speed.

Returning to step 310, if it is determined T1 is not between Th1 and Th2, the routine proceeds to step 328 as continued in FIG. 3B. At 328, the routine includes determining if the coolant temperature (T1) is higher than the second threshold temperature (Th2). Th2 may be pre-calibrated based on a highest allowable temperature of the radiator and the associated coolant system components. In one example, may be 60° C. If it is determined that T1 is not between Th1 and Th2 and also T1 is lower than Th2, it may be inferred that T1 is lower than Th1 and further decrease in coolant temperature is not desired. Further increase in coolant flow or air flow may not be desired and the routine may then proceed to 329. At 329, current pump and fan operation may be continued without any change in pump speed and/or fan speed.

If it is determined that T1 is higher than Th2, it may be inferred that the coolant temperature is higher than desired and engine cooling is to be increased. At 330, effectiveness of the radiator may be set to zero and the speed of the fan may be increased to the maximum speed (100%) to increase cooling air flow through the radiator. At 332, the pump speed may be increased in increments from the initial speed Sp1. In one example, the pump speed may be increased in increments of 5%.

At 334, a timer may be set at time ti and sampling of c may be initiated at intervals of n seconds. Said another way, after the initial start time, dented as ti, c may be estimated every n seconds. In one example, n may be 30 seconds.

At 336, the routine includes determining if rate of change in effectiveness as given by a difference between effectiveness measured at time ti+1 (such as n seconds after ti) and effectiveness measured at time ti divided by n is higher than the first threshold effectiveness (Thε1). In one example, Thε1 may be 0.05. If it is determined that (ε(ti+1)−ε(ti))/n is greater than Thε1, it may be inferred that an increase in coolant mass flow rate may be desired and the routine may return to step 332 and pump speed may be increased in increments. If it is determined that (ε(ti+1)−ε(ti))/n is less than Thε1, the routine proceeds to step 338.

AT 338, the routine includes determining if T1 continues to be above the second threshold temperature (Th2). If it is determined that T1 has reduced to below Th2, the routine may return to step 310 (in FIG. 3A) and continue forward. If it is determined that T2 continues to be above Th2, it may be inferred that further engine cooling may be desired. At 340, current operation of the fan at maximum speed may be continued while the pump speed may be continued to be ramped up incrementally until a maximum pump speed is reached.

FIG. 4 shows a flow-chart of a second example method 400 for adjusting speed of a fan (such as fan 91 in FIG. 1) supplying air flow through a heat exchanger (such as radiator 80 in FIG. 1) of an engine cooling system and a water pump (such as pump 86 in FIG. 1) circulating coolant through the engine cooling system.

In this method, a model may be used to adjust pump speed corresponding to a fan speed. The model including a three-dimensional map/look-up table may be populated with experimental data based on radiator effectiveness. As an example, the model may be populated based on experimental data as shown in FIGS. 5A and 5B. The model may take into account air flow through the grill radiator shroud and surrounding at different fan speeds. In one example, the model may include pump speed corresponding to fan speed such that radiator effectiveness may be maximized. The pump speed may be capped at a threshold pump speed above which radiator effectiveness may not further increase while power consumption may increase. In this method, real-time estimation of radiator effectiveness is no longer carried out and the pump speed is adjusted based on the fan speed using the model such that the radiator effectiveness is maximized in all operating conditions.

At 402, the routine includes determining if the engine is operating. Engine operation may include combustion of fuel and air in engine cylinders to generate power. Engine operation also causes generation of heat which is dissipated via the cooling system. If it is determined that the engine is not operating, at 404, current pump and fan operation may be maintained. In one example, if the vehicle is not operating such that the engine and the electric motor is not used to propel the vehicle, coolant circulation through the engine may be suspended through the engine and the pump may be maintained in an off state. Similarly, if the vehicle is not operating, due to engine cooling not desired, the fan may be maintained in an off state. In another example, if the vehicle is being propelled via torque from an electric machine and cooling of electric machine components is desired, the pump and the fan may be operated at pre-calibrated speeds to circulate coolant through one or more of the electric machine (e.g., motor) and system battery to absorb heat from the one or more of electric machine and system battery. The pre-calibrated fan speed and pump speed may be based on an amount of heat generated during operation of the electric machine when the engine is not combusting.

If it is determined that the engine is operating, it is inferred that engine cooling is desired. At 406, the pump maybe operated at a first pump speed (Sp1) and the fan may be operated at a first fan speed (Sf1). In one example, Sp1 and Sf1 may be determined based on engine operating conditions such as engine load, engine speed, engine temperature. The controller may use a look-up table to estimate Sp1 and Sf1 with the engine operating conditions as inputs and Sp1 and Sf1 as outputs. In another example, at engine start, Sp1 and Sf1 may be set to predetermined values and then subsequently adjusted based on coolant temperature and effectiveness of the radiator. As an example, the Sp1 may be operating the pump at 30% cycle and Sf1 may be operating the fan at 10% of maximum speed.

At 408, temperature (T1) of coolant entering the radiator via a coolant line may be estimated via a temperature sensor (such as temperature sensor 104 in FIG. 1) coupled to a coolant inlet of the radiator. The temperature sensor may estimate temperature of coolant entering the radiator after circulating through the engine with heat from the engine being transferred to the coolant.

At 410, the routine includes determining if the coolant temperature (T1) is higher than a first threshold temperature (Th1) but lower than a second threshold temperature (Th2). Th1 and Th2 may be pre-calibrated based on engine operating conditions such as engine load, engine speed, engine temperature and other components thermal requirements. Th1 may be lower than Th2. In one example, Th1 may be 35° C. and Th2 may be 60° C. If it is determined that the T1 is between Th1 and Th2, at 412, the fan speed may be increased in increments and the pump speed may be correspondingly adjusted based on the model. In one example, the fan speed may be increased in increments of 10%. As an example, the controller may use the model (such as a look-up table) to determine the pump speed with the fan speed as input and the pump speed as output.

At 414, a timer may be set at time ti and sampling of T1 may be initiated at intervals of n seconds. Said another way, after the initial start time, dented as ti, T1 may be estimated every n seconds. In one example, n may be 30 seconds.

At 416, the routine includes determining if a rate of change in coolant temperature as given by a difference between T1 measured at time ti+1 (such as n seconds after ti) and T1 measured at time ti divided by n is higher than a fifth threshold temperature (Th5). Th5 may be pre-calibrated based on engine operating conditions such as engine load, engine speed, and engine temperature. If it is determined that (T1(ti+1)−T1(ti))/n is greater than Th5, it may be inferred that an increase in cooling may be desired and the routine may return to step 412 and fan speed may be increased in increments with corresponding adjustments to pump speed. If it is determined that (T1(ti+1)−T1(ti))/n is less than Th5, the routine proceeds to step 418.

At 418, the routine includes determining if a difference between coolant temperature at time ti+1 (such as n seconds after ti) and coolant temperature at time ti is less than zero. If it is determined that T1(ti+1)−T1(ti) is lower than zero, it may be inferred that overcooling condition may be present, and the routine may proceed to step 420 to reduce the level of engine cooling.

At 420, the fan speed may be reduced in increments and pump speed may be adjusted based on the model to correspond to the reduced fan speed. In one example, the fan speed may be reduced in increments of 10%. As an example, the controller may use the model (such as a look-up table) to determine the pump speed with the reduced fan speed as input and the pump speed as output. By opportunistically reducing each of the fan speed and adjusting pump speed based on the model, radiator effectiveness may be improved, and power usage may be reduced.

If it is determined that T1(ti+1)−T1(ti) is higher than zero and less than Th5, it may be inferred that the temperature of coolant entering the radiator is stabilizing over time and further increase in coolant flow or air flow is not desired. At 428, current pump and fan operation may be continued without any change in pump speed and/or fan speed.

Returning to step 410, if it is determined T1 is not between Th1 and Th2, the routine proceeds to step 422. At 422, the routine includes determining if the coolant temperature (T1) is higher than the second threshold temperature (Th2). Th2 may be pre-calibrated based on engine operating conditions such as engine load, engine speed, and engine temperature. In one example, may be 60° C. If it is determined that T1 is not between Th1 and Th2 and also T1 is lower than Th2, it may be inferred that T1 is lower than Th1 and further decrease in coolant temperature is not desired. Further increase in coolant flow or air flow may not be desired and the routine may then proceed to 428. At 428, current pump and fan operation may be continued without any change in pump speed and/or fan speed.

If it is determined that T1 is higher than Th2, it may be inferred that the coolant temperature is higher than desired and engine cooling is to be increased. At 424, the speed of the fan may be increased to the maximum speed (100%) to increase cooling air flow through the radiator. For the maximum fan speed, the pump speed may be adjusted based on the model to optimize radiator effectiveness.

AT 426, the routine includes determining if T1 continues to be above the second threshold temperature (Th2). If it is determined that T1 has reduced to below Th2, the routine may return to step 410 and continue from thereon. If it is determined that T2 continues to be above Th2, it may be inferred that further engine cooling may be desired. At 428, current operation of the fan at maximum speed may be continued while the pump speed may be continued to be adjusted to attain maximum radiator effectiveness.

In this way, an effectiveness of a radiator of the engine cooling system may be estimated as a function of each of a coolant temperature entering the radiator, an inlet air temperature, and an outlet air temperature and a speed of a pump circulating coolant through the cooling system may be adjusted based on the estimated effectiveness of the radiator. By using instantaneous cooling demand based on a change of coolant temperature over time, a speed of the fan may be adjusted to deliver the desired air flow to the system. By accurately estimating the effectiveness of the radiator and adjusting pump speed based on the radiator effectiveness, parasitic loss of power may be reduced and efficiency of the engine cooling system may be improved.

In one example, a method for operating a vehicle, comprises: adjusting a speed of a cooling fan and a speed of a cooling pump of the vehicle based on a ratio of temperature differences of a heat exchanger. In the preceding example, the method further comprising, additionally or optionally, the cooling pump circulates coolant through an engine coupled to the vehicle and then through the heat exchanger, and wherein the fan is coupled to the heat exchanger. In any or all of the preceding examples, additionally or optionally, the ratio of temperature differences includes a first difference between a temperature of coolant entering the heat exchanger and a temperature of air entering the heat exchanger and a second difference between a temperature of air exiting the heat exchanger and the temperature of air entering the heat exchanger. In any or all of the preceding examples, additionally or optionally, the temperature of coolant entering the heat exchanger is estimated based on an input of a first temperature sensor coupled to a coolant line flowing coolant from the engine into the heat exchanger. In any or all of the preceding examples, additionally or optionally, the temperature of air entering the heat exchanger is estimated based on an input of a second temperature sensor coupled to a first side of the heat exchanger proximal to a grille, and wherein the temperature if air exiting the heat exchanger is estimated based on an input of a second temperature sensor coupled to a second side of the heat exchanger proximal to the fan, the first side opposite to the second side. Any or all of the preceding examples, further comprising, additionally or optionally, in response to the temperature of the coolant entering the heat exchanger being between a first temperature threshold and a second temperature threshold, incrementally increasing each of the speed of the fan and the speed of the pump, and sampling the ratio, the first threshold temperature lower than the second threshold temperature. In any or all of the preceding examples, additionally or optionally, sampling the ratio includes estimating the ratio at threshold intervals of time. In any or all of the preceding examples, additionally or optionally, adjusting based on the ratio includes, in response to a rate of change of the sampled ratio being lower than a threshold ratio and a change in the temperature of coolant being below a threshold temperature, decreasing each of the speed of the fan and the speed of the pump. In any or all of the preceding examples, the method further comprising, additionally or optionally, in response to the temperature of the coolant entering the heat exchanger being higher than the second temperature threshold, increasing the speed of the fan to a maximum fan speed and incrementally increasing the speed of the pump while sampling the ratio. In any or all of the preceding examples, additionally or optionally, adjusting based on the ratio includes, in response to the rate of change of the sampled ratio being lower than the threshold ratio and the temperature of the coolant entering the heat exchanger being higher than the second temperature threshold, increasing the speed of the pump while maintaining operation of the fan at the maximum fan speed.

In another example, a method for an engine cooling system of a vehicle, comprises: adjusting a speed of a fan coupled to a radiator of the engine cooling system based on a thermal load, estimating effectiveness of the radiator as a function of each of a coolant temperature entering the radiator, an inlet air temperature, and an outlet air temperature, and adjusting a speed of a pump circulating coolant through the cooling system based on the estimated effectiveness of the radiator. In the preceding example, additionally or optionally, the effectiveness of the radiator is estimated as a ratio of first a difference between the coolant temperature and the inlet air temperature and a second difference between the outlet air temperature and the inlet air temperature; and wherein the thermal load is based on a change in the coolant temperature over time. In any or all of the preceding examples, additionally or optionally, adjusting the speed of the pump and the speed of the fan includes increasing the speed of the pump and the speed of the fan incrementally in response to a higher than threshold coolant temperature, estimating the effectiveness at regular intervals, and then further adjusting the speed of the pump based on an average effectiveness and adjusting the speed of the fan based on a change in coolant temperature. In any or all of the preceding examples, additionally or optionally, further adjusting includes, in response to a a lower than threshold change in coolant temperature, reducing each of the speed of the fan and the speed of the pump. In any or all of the preceding examples, the method further comprising, additionally or optionally, in response to a lower than threshold coolant temperature, operating the pump at a first constant speed and the fan at a second constant speed.

In yet another example, system for an engine of a vehicle, comprises: a controller including executable instructions stored in a non-transitory memory that cause the controller to: during engine operation, adjust speed of a fan and a speed of a pump of a cooling system based on one or more of an estimated effectiveness of a radiator of the cooling system and a temperature of coolant entering the radiator, populate a model relating the speed of the fan and the speed of the pump with an effectiveness of the radiator, further adjust the speed of the fan and the speed of the pump based on the temperature of coolant entering the radiator and the model. In the preceding example, additionally or optionally, model is populated based on the speed of the pump, the speed of the fan, and the effectiveness of the radiator corresponding to a plurality of vehicle speed, the model selecting the speed of the pump corresponding to the speed of the fan for a maximum effectiveness of the radiator. In any or all of the preceding examples, additionally or optionally, the temperature of coolant entering the radiator is estimated via a first temperature sensor coupled to an inlet flowing coolant from the engine to the radiator, and wherein the-speed of the fan is adjusted based on a rate of change in temperature of coolant entering the radiator. In any or all of the preceding examples, additionally or optionally, further adjusting the speed of the fan and the speed of the pump includes in response to the temperature of the coolant entering the radiator being between a first temperature threshold and a second temperature threshold, incrementally increasing each of the speed of the fan and adjusting the speed of the pump corresponding to the speed of the fan based on the model, the first threshold temperature lower than the second threshold temperature. In any or all of the preceding examples, additionally or optionally, further adjusting the speed of the fan and the speed of the pump further includes in response to the temperature of the coolant entering the radiator being higher than the second temperature threshold, increasing the speed of the fan to a maximum fan speed and adjusting the speed of the pump corresponding to the maximum fan speed based on the model.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Moreover, unless explicitly stated to the contrary, the terms "first," "second," "third," and the like are not intended to denote any order, position, quantity, or importance, but rather are used merely as labels to distinguish one element from another. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for operating a vehicle, the method comprising:

adjusting a speed of a cooling fan and a speed of a cooling pump of the vehicle based on a ratio of temperature differences of a heat exchanger; and in response to a temperature of the coolant entering the heat exchanger being between a first temperature threshold and a second temperature threshold, incrementally increasing each of the speed of the fan and the speed of the pump, and sampling the ratio.

2. The method of claim 1, wherein the cooling pump circulates coolant through an engine coupled to the vehicle and then through the heat exchanger, and wherein the fan is coupled to the heat exchanger.

3. The method of claim 2, wherein the ratio of temperature differences includes a first difference between the temperature of coolant entering the heat exchanger and a temperature of air entering the heat exchanger and a second difference between a temperature of air exiting the heat exchanger and the temperature of air entering the heat exchanger.

4. The method of claim 3, wherein the temperature of coolant entering the heat exchanger is estimated based on an input of a first temperature sensor coupled to a coolant line flowing coolant from the engine into the heat exchanger.

5. The method of claim 3, wherein the temperature of air entering the heat exchanger is estimated based on an input of a second temperature sensor coupled to a first side of the heat exchanger proximal to a grille, and wherein the temperature of air exiting the heat exchanger is estimated based on an input of a third temperature sensor coupled to a second side of the heat exchanger proximal to the fan, the first side opposite to the second side.

6. The method of claim 1, wherein sampling the ratio includes estimating the ratio following threshold intervals of time, wherein the first temperature threshold is lower than the second temperature threshold.

7. The method of claim 6, wherein adjusting based on the ratio includes, in response to a rate of change of the sampled ratio being lower than a threshold ratio and a change in the temperature of coolant entering the heat exchanger being below a third temperature threshold, decreasing each of the speed of the fan and the speed of the pump.

8. The method of claim 7, further comprising, in response to the temperature of the coolant entering the heat exchanger being higher than the second temperature threshold, increasing the speed of the fan to a maximum fan speed and incrementally increasing the speed of the pump while sampling the ratio.

9. The method of claim 8, wherein adjusting based on the ratio includes, in response to the rate of change of the sampled ratio being lower than the threshold ratio and the temperature of the coolant entering the heat exchanger being higher than the second temperature threshold, increasing the speed of the pump while maintaining operation of the fan at the maximum fan speed.

10. A method for an engine cooling system of a vehicle, comprising:

adjusting a speed of a fan coupled to a radiator of the engine cooling system based on a thermal load;

estimating an effectiveness of the radiator as a function of each of a coolant temperature entering the radiator, an inlet air temperature, and an outlet air temperature; and adjusting a speed of a pump circulating coolant through the engine cooling based on the estimated effectiveness of the radiator.

11. The method of claim 10, wherein the effectiveness of the radiator is estimated as a ratio of a first difference between the coolant temperature and the inlet air temperature and a second difference between the outlet air temperature and the inlet air temperature; and wherein the thermal load is based on a change in the coolant temperature over time.

12. The method of claim 10, wherein adjusting the speed of the pump and the speed of the fan includes:

increasing each of the speed of the pump and the speed of the fan incrementally in response to a higher than threshold coolant temperature;

estimating the effectiveness at regular intervals; and further adjusting the speed of the pump based on an average effectiveness and adjusting the speed of the fan based on a change in coolant temperature.

13. The method of claim 12, wherein further adjusting includes, in response to a lower than threshold change in coolant temperature, reducing each of the speed of the fan and the speed of the pump.

14. The method of claim 12, further comprising, in response to a lower than threshold coolant temperature, operating the pump at a first constant speed and the fan at a second constant speed.

15. A system for an engine, the system comprising:

a controller including executable instructions stored in a non-transitory memory that cause the controller to:

during engine operation, adjust each of a speed of a fan and a speed of a pump of a cooling system based on one or more of an estimated effectiveness of a radiator of the cooling system and a temperature of coolant entering the radiator;

populate a model relating the speed of the fan and the speed of the pump with an effectiveness of the radiator; and further adjust each of the speed of the fan and the speed of the pump based on the temperature of coolant entering the radiator and the model.

16. The system of claim 15, wherein the model is populated based on the speed of the pump, the speed of the fan, and the effectiveness of the radiator corresponding to a plurality of vehicle speed, the model selecting the speed of the pump corresponding to the speed of the fan for a maximum effectiveness of the radiator.

17. The system of claim 16, wherein the temperature of coolant entering the radiator is estimated via a first temperature sensor coupled to an inlet flowing coolant from the engine to the radiator, and wherein the speed of the fan is adjusted based on a rate of change in temperature of coolant entering the radiator.

18. The system of claim 15, wherein further adjusting the speed of the fan and the speed of the pump includes, in response to the temperature of the coolant entering the radiator being between a first temperature threshold and a second temperature threshold, incrementally increasing the speed of the fan and adjusting the speed of the pump corresponding to the speed of the fan based on the model, the first temperature threshold lower than the second temperature threshold.

19. The system of claim 18, wherein further adjusting each of the speed of the fan and the speed of the pump further includes, in response to the temperature of the coolant entering the radiator being higher than the second temperature threshold, increasing the speed of the fan to a maximum fan speed and adjusting the speed of the pump corresponding to the maximum fan speed based on the model.

* * * * *